US009715856B2

(12) United States Patent
Wang et al.

(10) Patent No.: US 9,715,856 B2
(45) Date of Patent: Jul. 25, 2017

(54) COMMON VOLTAGE ADJUSTMENT CIRCUIT FOR DISPLAY PANEL AND DISPLAY APPARATUS

(71) Applicants: BOE TECHNOLOGY GROUP CO., LTD., Beijing (CN); BEIJING BOE VISION-ELECTRONIC TECHNOLOGY CO., LTD., Beijing (CN)

(72) Inventors: Jianting Wang, Beijing (CN); Qin Tan, Beijing (CN)

(73) Assignees: BOE TECHNOLOGY GROUP CO., LTD., Beijing (CN); BEIJING BOE VISION-ELECTRONIC TECHNOLOGY CO., LTD., Beijing (CN)

( * ) Notice: Subject to any disclaimer, the term of this patent is extended or adjusted under 35 U.S.C. 154(b) by 291 days.

(21) Appl. No.: 14/408,080

(22) PCT Filed: May 20, 2014

(86) PCT No.: PCT/CN2014/077923

§ 371 (c)(1),
(2) Date: Dec. 15, 2014

(87) PCT Pub. No.: WO2015/096361

PCT Pub. Date: Jul. 2, 2015

(65) Prior Publication Data

US 2016/0293116 A1 Oct. 6, 2016

(30) Foreign Application Priority Data

Dec. 24, 2013 (CN) ..... 2013 1 0722980

(51) Int. Cl.
*G09G 3/36* (2006.01)

(52) U.S. Cl.
CPC ..... *G09G 3/36* (2013.01); *G09G 3/3655* (2013.01); *G09G 3/3696* (2013.01);
(Continued)

(58) Field of Classification Search
CPC ... G09G 2310/0291; G09G 2320/0204; G09G 2320/0233; G09G 2320/0247;
(Continued)

(56) References Cited

U.S. PATENT DOCUMENTS 7,138,996 B2 * 11/2006 Lee ..... G09G 3/3655 345/214
7,400,312 B2 * 7/2008 Hung ..... G09G 3/3655 341/154
(Continued)

FOREIGN PATENT DOCUMENTS

CN 1021605 C 7/1993
CN 1499478 A 5/2004
(Continued)

OTHER PUBLICATIONS

International Search Report Appln. No. PCT/CN2014/077923; Dated Sep. 28, 2014.
(Continued)

*Primary Examiner* — Dmitriy Bolotin
(74) *Attorney, Agent, or Firm* — Ladas & Parry LLP

(57) ABSTRACT

Provided are a common voltage adjustment circuit for a display panel and a display apparatus. The adjustment circuit comprises: a filter unit (101) configured to filter a PWM signal provided externally and provide a DC voltage signal obtained through the filtering to a first voltage clamp unit; a first voltage clamp unit (102) configured to adjust the DC voltage signal to obtain a first adjusted signal and provide the first adjusted signal to a feedback amplification unit; a feedback amplification unit (103) configured to amplify the
(Continued)

first adjusted signal to obtain a first amplified signal and provide the first amplified signal to a second voltage clamp unit; and a second voltage clamp unit (104) configured to adjust the first amplified signal to output a second adjusted signal and provide the voltage value of the second adjusted signal to the display panel. The adjustment circuit can rapidly and precisely adjust the common voltage of the display panel to reduce the flicker phenomenon during the displaying of the display panel.

20 Claims, 2 Drawing Sheets

(52) U.S. Cl.
CPC ..... *G09G 2310/0291* (2013.01); *G09G 2320/0204* (2013.01); *G09G 2320/0233* (2013.01); *G09G 2320/0247* (2013.01); *G09G 2330/021* (2013.01)

(58) Field of Classification Search
CPC .. G09G 2330/021; G09G 3/36; G09G 3/3655; G09G 3/3696
See application file for complete search history.

(56) References Cited

U.S. PATENT DOCUMENTS

| | | | | |
|---|---|---|---|---|
| 8,106,863 | B2 * | 1/2012 | Huang | G09G 3/3655 345/87 |
| 8,106,869 | B2 * | 1/2012 | Feng | G09G 3/3655 345/92 |
| 2004/0085371 | A1 * | 5/2004 | Lee | G09G 3/3655 346/45 |
| 2005/0259452 | A1 * | 11/2005 | Cho | H02M 3/3385 363/51 |
| 2006/0170640 | A1 | 8/2006 | Okuno | |
| 2007/0012897 | A1 * | 1/2007 | Lee | G02F 1/133382 252/299.1 |
| 2007/0024560 | A1 * | 2/2007 | Kim | G09G 3/3614 345/94 |
| 2007/0164963 | A1 * | 7/2007 | Kim | G09G 3/3655 345/98 |
| 2008/0018634 | A1 * | 1/2008 | Yeo | G09G 3/3648 345/210 |
| 2008/0180419 | A1 * | 7/2008 | Tung | G09G 3/3655 345/204 |
| 2008/0198125 | A1 * | 8/2008 | Park | G09G 3/3696 345/98 |
| 2009/0002306 | A1 * | 1/2009 | Huang | G09G 3/3655 345/94 |
| 2009/0167659 | A1 * | 7/2009 | Kim | G09G 3/3655 345/89 |
| 2010/0321359 | A1 | 12/2010 | Liu et al. | |

FOREIGN PATENT DOCUMENTS

| | | | |
|---|---|---|---|
| CN | 103680455 | A | 3/2014 |
| EP | 0428250 | A2 | 8/1990 |
| JP | 2006-209064 | A | 8/2006 |
| KR | 1020050023080 | A | 3/2005 |
| KR | 1020070014535 | A | 2/2007 |
| KR | 20110063980 | A | 6/2011 |
| TW | 201101282 | A | 1/2011 |

OTHER PUBLICATIONS

First Chinese Office Action Appln. No. 201310722980.1; Dated Apr. 30, 2015.
International Preliminary Report on Patentability issued Jun. 28, 2016; PCT/CN2014/077923.
Second Chinese Office Action Appln. No. 201310722980.1; Dated Oct. 12, 2015.

* cited by examiner

COMMON VOLTAGE ADJUSTMENT CIRCUIT FOR DISPLAY PANEL AND DISPLAY APPARATUS

TECHNICAL FIELD OF THE DISCLOSURE

The present disclosure relates to a common voltage adjustment circuit for a display panel and a display apparatus.

BACKGROUND

The LCD (Liquid Crystal Display has been widely accepted by people due to its characteristics of lightness, thinness, low power cost and so on. Although the LCD has greatly reduced screen flicker than the CRT (Cathode Ray Tube) display, it still has some flicker. The screen flicker easily causes a person's visual fatigue and also reduces the use life of the LCD.

The reason for LCD flicker is the nonuniform brightness of pixels on the display panel. The pixel brightness depends on the deflection of the liquid crystal molecule and is proportional to the driving voltage of the pixel, and the driving voltage usually takes a common voltage $V_{com}$ as a reference. Due to the variance of manufacturing process, the common voltage reference points for different pixels of the same LCD panel would be different, but the common voltage supplied for different pixels are practically the same, which results in brightness nonuniformity of pixels and thus the screen flicker phenomenon. For example, the common voltage for a LCD panel is generally set as 5.5 V at the manufacturer, while the driving voltage levels for pixels are between 0V and 10V. As such, within the entire voltage range, different areas of the same LCD panel would have different sectional voltage values. The driving voltage for some areas is practically 4.5 V while that for other areas can be 5.5 V. As for the entire voltage range, different sectional voltages would cause different pixel brightness, thereby resulting in the screen flicker phenomenon. In other words, the flicker of the LCD panel comes from the nonuniform brightness of pixels due to the offset of the common voltage $V_{com}$.

Generally, many LCD panel manufacturers adjust the common voltage before releasing the products, but such adjustment is a one-time adjustment before releasing. The voltage $V_{com}$ may offset due to time and temperature among others during practical usage; therefore, such a one-time adjustment cannot reduce screen flicker essentially. In addition, the adjustment of the common voltage $V_{com}$ before releasing is usually performed manually by additionally adding an adjustment resistor. Such an adjustment has low precision and low efficiency.

SUMMARY

At least one embodiment of the present disclosure provides a common voltage adjustment circuit for a display panel and a display apparatus to rapidly and precisely adjust the common voltage so as to reduce the flicker phenomenon during the displaying of the display panel.

At least one embodiment of the present disclosure provides a common voltage adjustment circuit for a display panel, comprising: a filter unit configured to filter a pulse width modulation (PWM) signal provided externally and provide a direct current (DC) voltage signal obtained through the filtering to a first voltage clamp unit; a first voltage clamp unit configured to adjust the DC voltage signal to obtain a first adjusted signal and provide the first adjusted signal to a feedback amplification unit; a feedback amplification unit configured to amplify the first adjusted signal to obtain a first amplified signal and provide the first amplified signal to a second voltage clamp unit; and a second voltage clamp unit configured to adjust the first amplified signal to output a second adjusted signal and provide the voltage value of the second adjusted signal to the display panel.

In at least one embodiment of the present disclosure, fast and precise adjustment for the common voltage of the display panel is realized by receiving an external PWM signal for adjusting the common voltage of the display panel and filtering and amplifying the PWM Optionally, the filter unit comprises a first resistor, a second resistor, a first capacitor and a second capacitor; a first terminal of the first resistor is connected to a first terminal of the first capacitor as an input terminal of the filter unit, a second terminal of the first resistor is connected to a first terminal of the second resistor and a first terminal of the second capacitor respectively, a second terminal of the second resistor is taken as an output terminal of the filter unit, and both a second terminal of the first capacitor and a second terminal of the second capacitor are connected to a reference ground a reference ground; and the output terminal of the filter unit provides the DC voltage signal to the first voltage clamp unit.

Optionally, the first voltage clamp unit comprises a third resistor and a fourth resistor; a first terminal of the third resistor is connected to a DC power supply, a second terminal of the third resistor and a first terminal of the fourth resistor is connected to a first pull-down node, a second terminal of the fourth resistor is connected to a reference ground; and the first voltage clamp unit provides the first adjusted signal to the feedback amplification unit through the first pull-down node.

Optionally, the feedback amplification unit comprises an amplifier, a fifth resistor, a sixth resistor and a seventh resistor; the amplifier comprises a positive input terminal, a negative input terminal and an output terminal; a first terminal of the fifth resistor is connected to the positive terminal of the amplifier; both a first terminal of the sixth resistor and a first terminal of the seventh resistor are connected to the negative terminal of the amplifier; a second terminal of the fifth resistor, a second terminal of the sixth resistor and the output terminal of the amplifier are connected as an output terminal of the feedback amplification unit; a second terminal of the seventh resistor is connected to a reference ground; and the output terminal of the feedback amplification unit provides the first amplified signal to the second voltage clamp unit.

Optionally, the amplifier further comprises a reference ground input terminal and a power supply input terminal.

Optionally, the second voltage clamp unit comprises an eighth resistor and ninth resistor; a first terminal of the eighth resistor is connected to a DC power supply; both a second terminal of the eighth resistor and a first terminal of the ninth resistor are connected to a second pull-down node; a second terminal of the ninth resistor is connected to a reference ground; and the second voltage clamp unit provides the voltage value of the second adjusted signal to the display panel through the second pull-down node.

Embodiments of the present disclosure can achieve the following benefits: fast and precise adjustment for the common voltage of the display panel is realized by receiving an external PWM signal for adjusting the common voltage of the display panel and filtering and amplifying the PWM signal, thereby reducing the flicker phenomenon during the displaying of the display panel.

At least one embodiment of the present disclosure provides a display apparatus comprising a common voltage adjustment circuit for a display panel as described in the above.

Embodiments of the present disclosure can achieve the following benefits: fast and precise adjustment for the common voltage of the display panel is realized by using a signal receiving unit to remotely or wirelessly receive a control signal and generate a PWM signal to control the adjustment of the driving voltage of the display panel, thereby reducing the flicker phenomenon during the displaying of the display panel.

DETAILED DESCRIPTION

Figure 1:
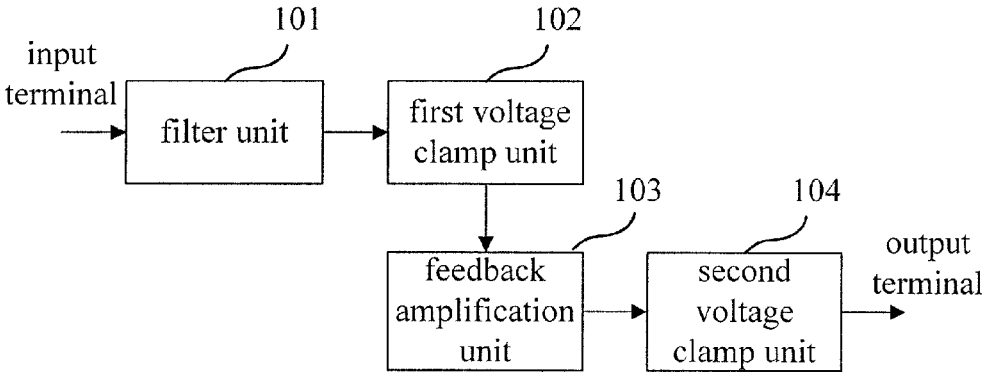
FIG. 1 is a schematic diagram of functional modules of a common voltage adjustment circuit for a display panel provided by an embodiment of the present disclosure.

In the following, detailed description will be made on the implementation of embodiments of the present disclosure in connection with the drawings. It is noted that the same or similar reference numerals in the drawings represent the same or similar elements. The following embodiments described with reference to the drawings are illustrative and only for explaining the present disclosure, but not be understood as limiting of the present disclosure.

FIG. 1 is a schematic diagram of a common voltage adjustment circuit for a display panel provided by an embodiment of the present disclosure. As shown in FIG. 1, the common voltage adjustment circuit for the display panel comprises a filter unit 101, a first voltage clamp unit 102, a feedback amplification unit 103 and a second voltage clamp unit 104. The filter unit 101 is connected to the first voltage clamp unit 102, the first voltage clamp unit 102 is connected to the feedback amplification unit 103, and the feedback amplification unit 103 is connected to the second voltage clamp unit 104.

The filter unit 101 is configured to filter a pulse width modulation (PWM) signal provided externally and provide a direct current (DC) voltage signal obtained through the filtering to the first voltage clamp unit 102. The PWM signal can be provided by an external circuit connected to the filter unit 101, and can also be provided to the filter unit 101 by an external device or circuit through a wireless network.

For example the PWM signal is output by control of a control chip of the display panel based on a register value. The register value can be changed by control of a debugging personnel of display panels in a convenient way, for example, changing corresponding register values through a button of a remote controller.

The first voltage clamp unit 102 is configured to adjust the DC voltage signal obtained through the filtering to obtain a first adjusted signal and provide the first adjusted signal to the feedback amplification unit 103.

The feedback amplification unit 103 is configured to amplify the first adjusted signal to obtain a first amplified signal and provide the first amplified signal to the second voltage clamp unit 104.

The second voltage clamp unit 104 is configured to adjust the first amplified signal to output a second adjusted signal and provide the voltage value of the second adjusted signal to the display panel.

In embodiments of the present disclosure, fast and precise adjustment for the common voltage of the display panel is realized by receiving an external PWM signal for adjusting the common voltage of the display panel and filtering and amplifying the PWM signal.

Figure 2:
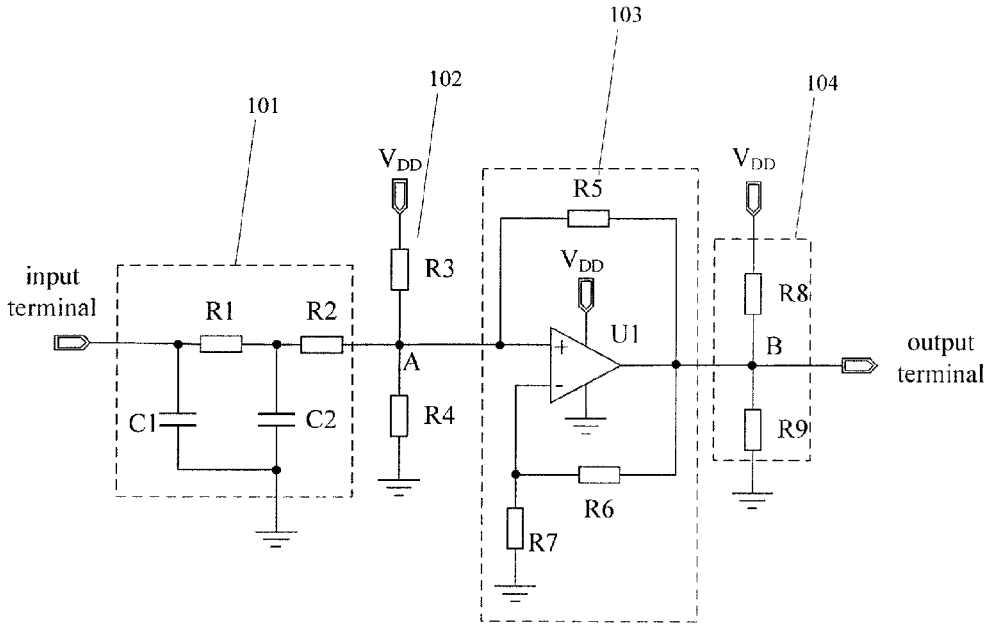
FIG. 2 is a circuit principle diagram of a common voltage adjustment circuit for a display panel provided by an embodiment of the present disclosure.

FIG. 2 is a circuit principle diagram of a common voltage adjustment circuit for a display panel provided by an embodiment of the present disclosure. As shown in FIG. 2, the filter unit 101 comprises a first resistor R1, a second resistor R2, a first capacitor C1 and a second capacitor C2.

A first terminal of the first resistor R1 is connected to a first terminal of the first capacitor C1 as an input terminal of the filter unit 101, a second terminal of the first resistor R1 is connected to a first terminal of the second resistor R2 and a first terminal of the second capacitor C2 respectively, a second terminal of the second resistor R2 is taken as an output terminal of the filter unit 101, and both a second terminal of the first capacitor C1 and a second terminal of the second capacitor C2 are connected to a reference ground.

In the embodiment, the received PWM signal is filtered by the filter unit 101, and corresponding DC voltage is obtained based on the duty cycle of the PWM The output terminal of the filter unit 101 provides the DC voltage signal to the first voltage clamp unit 102.

As shown in FIG. 2, the first voltage clamp unit 102 comprises a third resistor R3 and a fourth resistor R4.

A first terminal of the third resistor R3 is connected to a DC power supply $V_{DD}$, a second terminal of the third resistor R3 and a first terminal of the fourth resistor R4 is connected to a first pull-down node A, a second terminal of the fourth resistor R4 is connected to a reference ground.

The first voltage clamp unit 102 provides the first adjusted signal to the feedback amplification unit 103 through the first pull-down node A.

In the embodiment, the DC voltage provided by the filter unit 101 is clamped to obtain the first adjusted signal which is also a DC voltage signal.

As Shown in FIG. 2, the feedback amplification unit 103 comprises an amplifier U1, a fifth resistor R5, a sixth resistor R6 and a seventh resistor R7.

The amplifier U1 comprises a positive input terminal, a negative input terminal and an output terminal.

A first terminal of the fifth resistor R5 is connected to the positive terminal of the amplifier U1.

Both a first terminal of the sixth resistor R6 and a first terminal of the seventh resistor R7 are connected to the negative terminal of the amplifier.

A second terminal of the fifth resistor R5, a second terminal of the sixth resistor R6 and the output terminal of the amplifier U1 are connected as an output terminal of the feedback amplification unit 103.

A second terminal of the seventh resistor R7 is connected to a reference ground.

The output terminal of the feedback amplification unit 103 provides the first amplified signal to the second voltage clamp unit 104.

Optionally, the amplifier U1 further comprises a reference ground input terminal and a power supply input terminal connected to the DC power supply $V_{DD}$.

In the embodiment, a present stage negative feedback formed by the amplifier the sixth resistor R6 and the seventh resistor R1 realizes precise amplified output for the first adjusted signal provided by the first voltage clamp unit 102, and the outputted first amplified signal is a DC voltage, wherein the amplification coefficient is determined by the resistance ratio of the sixth resistor R6 to the seventh resistor R7.

As shown in FIG. 2, the second voltage clamp unit 104 comprises an eighth resistor R8 and ninth resistor R9.

A first terminal of the eighth resistor R8 is connected to the DC power supply $V_{DD}$.

Both a second terminal of the eighth resistor R8 and a first terminal of the ninth resistor R9 are connected to a second pull-down node B.

A second terminal of the ninth resistor R9 is connected to a reference ground.

The second voltage clamp unit 104 provides the voltage value of the second adjusted signal to the display panel through the second pull-down node B.

In the embodiment, the first amplified signal provided by the feedback amplification 103 is clamped to obtain the second adjusted signal which is also a DC voltage signal. The second voltage clamp unit 104 provides the DC voltage signal to the display panel to drive the panel to display.

Embodiments of the present disclosure can achieve the following benefits: fast and precise adjustment for the common voltage of the display panel is realized by receiving an external PWM signal for adjusting the common voltage of the display panel and filtering and amplifying the PWM signal, thereby reducing the flicker phenomenon during the displaying of the display panel.

Figure 3:
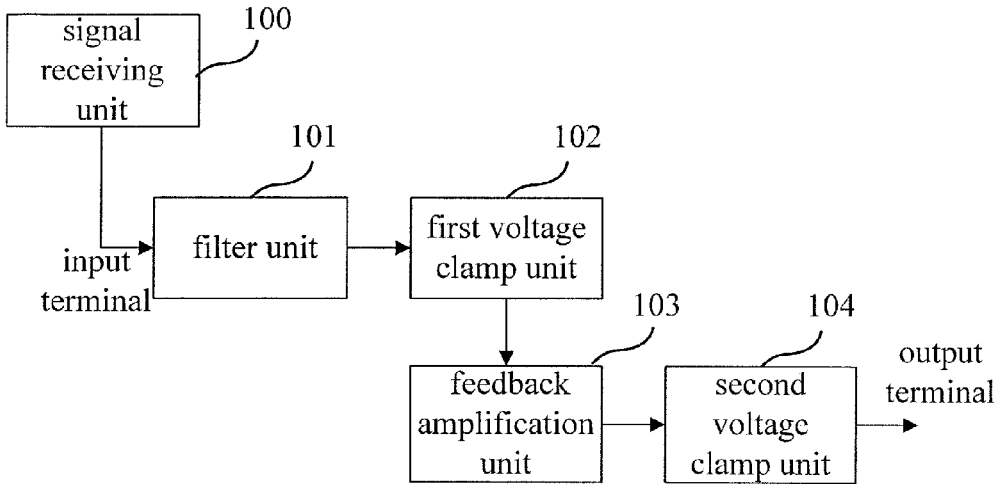
FIG. 3 is a schematic diagram of functional modules of another common voltage adjustment circuit for a display panel provided by an embodiment of the present disclosure.

FIG. 3 is a schematic diagram of functional modules of another common voltage adjustment circuit for a display panel provided by an embodiment of the present disclosure which differs from the adjustment circuit shown in FIG. 1 by further comprising a signal receiving unit 100 whose output terminal is connected to an input terminal of the filter unit 101.

The signal receiving unit 100 is configured to receive a control signal based on which the PWM signal is generated and provide the PWM signal to the filter unit 101.

The control signal carries instruction information and adjustment parameters for adjusting the common voltage of the display panel.

It is noted that the signal receiving unit 100 can be a CPU (Central Processing Unit) or an integrated circuit, or an embedded IC, which can wiredly or wirelessly receive the control signal and generate the PWM signal.

When the terminal for emitting the control signal is an external device, the control signal can be an infrared signal, a Bluetooth signal, a radio frequency signal or a network signal transmitted by a wireless local area network. Accordingly, the external device can be a remote controller, a signal transmitter, a personal terminal with the above signal transmitting function, or the like.

An embodiment of the present disclosure provides a display apparatus comprising a common voltage adjustment circuit for a display panel as described in the above.

Embodiments of the present disclosure can achieve the following benefits: fast and precise adjustment for the common voltage of the display panel is realized by using a signal receiving unit to remotely or wirelessly receive a control signal and generate a PWM signal to control the adjustment of the driving voltage of the display panel, thereby reducing the flicker phenomenon during the displaying of the display panel.

Obviously, those skilled in the art can make various changes or variations to the present disclosure without departing from the spirit and scope of the present disclosure. As such, if those changes or variations of the present disclosure fall within the scope of the claims of the present disclosure or equivalents thereof, the present disclosure is intended to contain those changes and variations.

The present application claims the priority of Chinese Patent Application No. 201310722980.1 filed on Dec. 24, 2013, the entire disclosed content of which is incorporated as part of the present application by reference.

What is claimed is:

1. A common voltage adjustment circuit for a display panel, comprising:

a filter unit configured to filter a pulse width modulation (PWM) signal provided externally and provide a DC voltage signal obtained through the filtering to a first voltage clamp unit;

a first voltage clamp unit configured to adjust the DC voltage signal to obtain a first adjusted signal and provide the first adjusted signal to a feedback amplification unit;

a feedback amplification unit configured to amplify the first adjusted signal to obtain a first amplified signal and provide the first amplified signal to a second voltage clamp unit; and a second voltage clamp unit configured to adjust the first amplified signal to output a second adjusted signal and provide a voltage value of the second adjusted signal to the display panel.

2. The adjustment circuit according to claim 1, wherein the filter unit comprises a first resistor, a second resistor, a first capacitor and a second capacitor;

a first terminal of the first resistor is connected to a first terminal of the first capacitor as an input terminal of the filter unit, a second terminal of the first resistor is connected to a first terminal of the second resistor and a first terminal of the second capacitor respectively, a second terminal of the second resistor is taken as an output terminal of the filter unit, and both a second terminal of the first capacitor and a second terminal of the second capacitor are connected to a reference ground; and the output terminal of the filter unit provides the DC voltage signal to the first voltage clamp unit.

3. The adjustment circuit according to claim 2, wherein the first voltage clamp unit comprises a third resistor and a fourth resistor;

a first terminal of the third resistor is connected to a DC power supply, a second terminal of the third resistor and a first terminal of the fourth resistor is connected to a first pull-down node, a second terminal of the fourth resistor is connected to a reference ground; and the first voltage clamp unit provides the first adjusted signal to the feedback amplification unit through the first pull-down node.

4. The adjustment circuit according to claim 3, wherein the feedback amplification unit comprises an amplifier, a fifth resistor, a sixth resistor and a seventh resistor;

the amplifier comprises a positive input terminal, a negative input terminal and an output terminal;

a first terminal of the fifth resistor is connected to the positive terminal of the amplifier;

both a first terminal of the sixth resistor and a first terminal of the seventh resistor are connected to the negative terminal of the amplifier;

a second terminal of the fifth resistor, a second terminal of the sixth resistor and the output terminal of the amplifier are connected as an output terminal of the feedback amplification unit;

a second terminal of the seventh resistor is connected to a reference ground; and the output terminal of the feedback amplification unit provides the first amplified signal to the second voltage clamp unit.

5. The adjustment circuit according to claim 4, wherein the amplifier further comprises a reference ground input terminal and a power supply input terminal.

6. The adjustment circuit according to claim 2, wherein the feedback amplification unit comprises an amplifier, a fifth resistor, a sixth resistor and a seventh resistor;

the amplifier comprises a positive input terminal, a negative input terminal and an output terminal;

a first terminal of the fifth resistor is connected to the positive terminal of the amplifier;

both a first terminal of the sixth resistor and a first terminal of the seventh resistor are connected to the negative terminal of the amplifier;

a second terminal of the fifth resistor, a second terminal of the sixth resistor and the output terminal of the amplifier are connected as an output terminal of the feedback amplification unit;

a second terminal of the seventh resistor is connected to a reference ground; and the output terminal of the feedback amplification unit provides the first amplified signal to the second voltage clamp unit.

7. The adjustment circuit according to claim 6, wherein the amplifier further comprises a reference ground input terminal and a power supply input terminal.

8. The adjustment circuit according to claim 2, wherein the second voltage clamp unit comprises an eighth resistor and ninth resistor;

a first terminal of the eighth resistor is connected to a DC power supply;

both a second terminal of the eighth resistor and a first terminal of the ninth resistor are connected to a second pull-down node;

a second terminal of the ninth resistor is connected to a reference ground; and the second voltage clamp unit provides the voltage value of the second adjusted signal to the display panel through the second pull-down node.

9. The adjustment circuit according to claim 2, further comprises:

a signal receiving unit whose output terminal is connected to an input terminal of the filter unit;

wherein the signal receiving unit is configured to receive a control signal based on which the PWM signal is generated and provide the PWM signal to the filter unit; and the control signal carries instruction information and adjustment parameters for adjusting the common voltage of the display panel.

10. The adjustment circuit according to claim 1, wherein the first voltage clamp unit comprises a third resistor and a fourth resistor;

a first terminal of the third resistor is connected to a DC power supply, a second terminal of the third resistor and a first terminal of the fourth resistor is connected to a first pull-down node, a second terminal of the fourth resistor is connected to a reference ground; and the first voltage clamp unit provides the first adjusted signal to the feedback amplification unit through the first pull-down node.

11. The adjustment circuit according to claim 10, wherein the feedback amplification unit comprises an amplifier, a fifth resistor, a sixth resistor and a seventh resistor;

the amplifier comprises a positive input terminal, a negative input terminal and an output terminal;

a first terminal of the fifth resistor is connected to the positive terminal of the amplifier;

both a first terminal of the sixth resistor and a first terminal of the seventh resistor are connected to the negative terminal of the amplifier;

a second terminal of the fifth resistor, a second terminal of the sixth resistor and the output terminal of the amplifier are connected as an output terminal of the feedback amplification unit;

a second terminal of the seventh resistor is connected to a reference ground; and the output terminal of the feedback amplification unit provides the first amplified signal to the second voltage clamp unit.

12. The adjustment circuit according to claim 11, wherein the amplifier further comprises a reference ground input terminal and a power supply input terminal.

13. The adjustment circuit according to claim 10, wherein the second voltage clamp unit comprises an eighth resistor and ninth resistor;

a first terminal of the eighth resistor is connected to the DC power supply;

both a second terminal of the eighth resistor and a first terminal of the ninth resistor are connected to a second pull-down node;

a second terminal of the ninth resistor is connected to a reference ground; and the second voltage clamp unit provides the voltage value of the second adjusted signal to the display panel through the second pull-down node.

14. The adjustment circuit according to claim 10, further comprises:

a signal receiving unit whose output terminal is connected to an input terminal of the filter unit;

wherein the signal receiving unit is configured to receive a control signal based on which the PWM signal is generated and provide the PWM signal to the filter unit; and the control signal carries instruction information and adjustment parameters for adjusting the common voltage of the display panel.

15. The adjustment circuit according to claim 1, wherein the feedback amplification unit comprises an amplifier, a fifth resistor, a sixth resistor and a seventh resistor;

the amplifier comprises a positive input terminal, a negative input terminal and an output terminal;

a first terminal of the fifth resistor is connected to the positive terminal of the amplifier;

both a first terminal of the sixth resistor and a first terminal of the seventh resistor are connected to the negative terminal of the amplifier;

a second terminal of the fifth resistor, a second terminal of the sixth resistor and the output terminal of the amplifier are connected as an output terminal of the feedback amplification unit;

a second terminal of the seventh resistor is connected to a reference ground; and the output terminal of the feedback amplification unit provides the first amplified signal to the second voltage clamp unit.

16. The adjustment circuit according to claim 15, wherein the amplifier further comprises a reference ground input terminal and a power supply input terminal.

17. The adjustment circuit according to claim 15, wherein the second voltage clamp unit comprises an eighth resistor and ninth resistor;

a first terminal of the eighth resistor is connected to a DC power supply;

both a second terminal of the eighth resistor and a first terminal of the ninth resistor are connected to a second pull-down node;

a second terminal of the ninth resistor is connected to a reference ground; and the second voltage clamp unit provides the voltage value of the second adjusted signal to the display panel through the second pull-down node.

18. The adjustment circuit according to claim 1, wherein the second voltage clamp unit comprises an eighth resistor and ninth resistor;

a first terminal of the eighth resistor is connected to a DC power supply;

both a second terminal of the eighth resistor and a first terminal of the ninth resistor are connected to a second pull-down node;

a second terminal of the ninth resistor is connected to a reference ground; and the second voltage clamp unit provides the voltage value of the second adjusted signal to the display panel through the second pull-down node.

19. The adjustment circuit according to claim 1, further comprises:

a signal receiving unit whose output terminal s connected to an input terminal of the filter unit;

wherein the signal receiving unit is configured to receive a control signal based on which the PWM signal is generated and provide the PWM signal to the filter unit; and the control signal carries instruction information and adjustment parameters for adjusting the common voltage of the display panel.

20. A display apparatus comprising a common voltage adjustment circuit for a display panel according to claim 1.

* * * * *